United States Patent [19]

Kuroda

[11] 4,376,413

[45] Mar. 15, 1983

[54] APPARATUS FOR CONTROLLING TIMINGS OF THROWING ON OR OFF CYLINDERS OF PRINTING PRESS

[75] Inventor: Tamio Kuroda, Soka, Japan

[73] Assignee: Komori Printing Machinery Co., Ltd., Tokyo, Japan

[21] Appl. No.: 317,431

[22] Filed: Nov. 2, 1981

[30] Foreign Application Priority Data

Dec. 5, 1980 [JP] Japan ..... 55/175329[U]

[51] Int. Cl.[3] ..... B41F 5/06; B41F 7/04

[52] U.S. Cl. ..... 101/182; 101/247; 101/140

[58] Field of Search ..... 101/180–184, 101/139, 143–145, 148, 152, 247, 216–218, 220, 221, 137, 138, 352, 191–192

[56] References Cited

U.S. PATENT DOCUMENTS

| | | | |
|---|---|---|---|
| 3,191,530 | 6/1965 | Fath et al. | 101/247 X |
| 3,296,521 | 1/1967 | Wilberger | 101/247 X |
| 3,473,468 | 10/1969 | Van Deman et al. | 101/184 X |
| 3,477,367 | 11/1969 | Richards | 101/184 X |
| 3,624,359 | 11/1971 | Roote | 101/184 X |
| 3,921,519 | 11/1975 | Zimmer | 101/182 X |
| 3,998,156 | 12/1976 | Zimmer | 101/182 X |
| 4,109,574 | 8/1978 | Forster | 101/247 |
| 4,116,125 | 9/1978 | Forster et al. | 101/184 X |
| 4,240,346 | 12/1980 | Landis et al. | 101/182 X |
| 4,281,595 | 8/1981 | Fujishiro | 101/182 X |

FOREIGN PATENT DOCUMENTS

| | | | |
|---|---|---|---|
| 2038440 | 7/1980 | United Kingdom | 101/181 |

*Primary Examiner*—E. H. Eickholt

*Attorney, Agent, or Firm*—Thompson, Birch, Gauthier & Samuels

[57] ABSTRACT

In a printing press including an intaglio cylinder, an impression cylinder and a blanket cylinder, for the purpose of throwing on and off these cylinders there is provided a control apparatus comprising a first detection switch which produces a selection signal when a rotating radial projection passes by, and a plurality of second detection switches which generate timing signals when passing by a plurality of radially spaced projections. The selection signal is used to select either one of the second selection switches, and the timing signal generated by a selected second detection switch is used to throw on and off the cylinders.

According to this invention it is not necessary to use a number of expensive multistage preset counters which are liable to misoperate due to noise.

3 Claims, 5 Drawing Figures

FIG.3
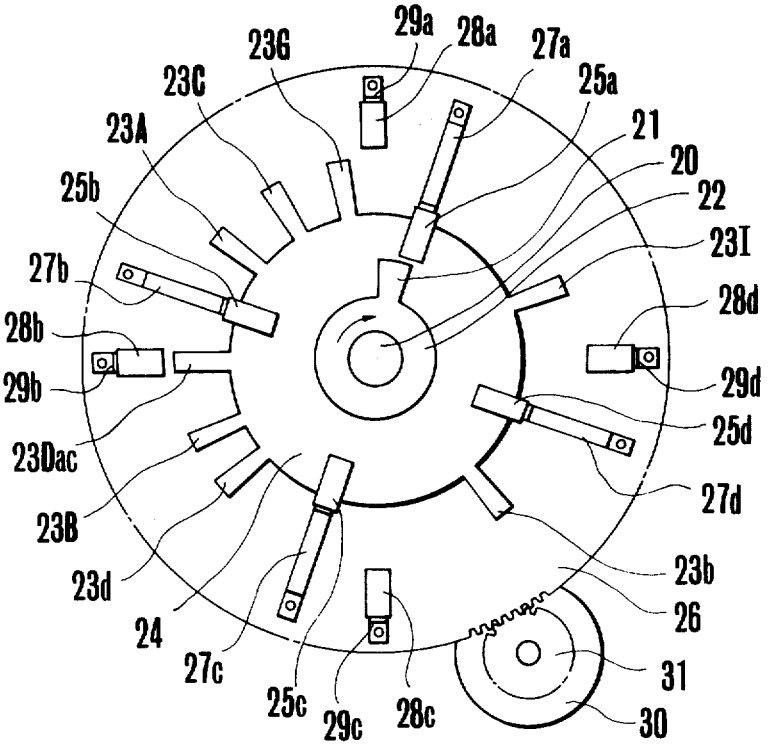
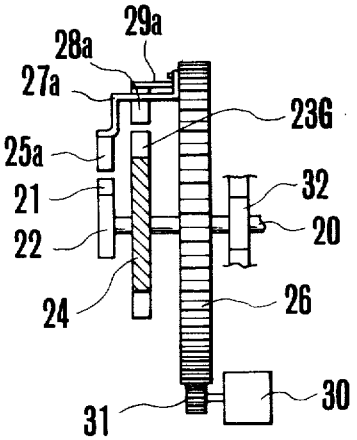
FIG.4

APPARATUS FOR CONTROLLING TIMINGS OF THROWING ON OR OFF CYLINDERS OF PRINTING PRESS

BACKGROUND OF THE INVENTION

This invention relates to apparatus of controlling the timings of throwing on or off cylinders of a printing press.

In a multicolor printing press it is essential to accurately print on successively supplied sheets of paper supplied from a paper feeder. For this purpose it is necessary to throw on or throw off printing cylinders and inking rollers at suitable timings commensurate with the supply of the printing paper. If the timings were not correct, sheets of paper not printed at all, or partially printed or printed with only one color would be delivered, or a printing pressure would be applied to the impression cylinder at a position where no sheet of paper is present on the printing cylinders thus spoiling the printing cylinders with printing ink.

According to prior apparatus for controlling the timings for throwing on or off the printing cylinders, a pulse shaped timing signal is generated in synchronism with the angle of rotation of the printing cylinders, and the number of the timing signals is counted by a preset counter after commencing the paper supply so that the counter produces an output signal when a preset number of the timing signals is counted and the printing cylinders are thrown on or thrown off with the output signal. With this apparatus, it is necessary to provide preset counters of the number equal to that of the printing cylinders or inking rollers to be controlled so that in a multicolor printing press it is necessary to provide a large number of the preset counters.

Furthermore, with the control apparatus described above, since the accuracy of timing is determined in accordance with the spacing or interval between the timing pulses, in order to improve the control accuracy it is necessary to increase the number of the timing pulses outputted per one revolution of the printing cylinders or during a printing time for each sheet of paper. As the number of the pulses increases in this manner, it is necessary to use a preset counter having a high response speed. Moreover, in the multicolor printing press, as the number of the steps of printing increases it is necessary to count a larger number of pulses, thus requiring to use a preset counter having larger number of stages. In other words, as it is necessary to use many expensive preset counters, the cost of the apparatus increases. Since highly sensitive preset counters are used, even a small noise causes misoperation of the counter.

SUMMARY OF THE INVENTION

Accordingly it is an object of this invention to provide an improved apparatus capable of accurately controlling the timing of throwing on and off cylinders of a printing press.

According to this invention there is provided an apparatus for controlling timings of throwing on and off a printing cylinder of a printing press comprising a first detection member mounted on a driving shaft of a n times roller, where n is an integer larger than 2, n first detection means for producing a selection signal when the first detection member passes by, the first detection means being spaced circumferentially by an equal angle, a plurality of second detection members mounted on the driving shaft at predetermined angular positions, n second detection means for producing timing signals when the second detection members pass by, the second detection means being spaced circumferentially by an equal angle, means for selecting either one of the second detection means according to the selection signal and means responsive to a timing signal produced by the selected second detection means for throwing on or off the printing cylinder of the printing press.

BRIEF DESCRIPTION OF THE DRAWINGS

In the accompanying drawings:

FIG. 3 is a front view showing a timing pulse generator;

FIG. 4 is a side view of the timing pulse generator shown in FIG. 3; and

DESCRIPTION OF THE PREFERRED EMBODIMENT

Figure 1:
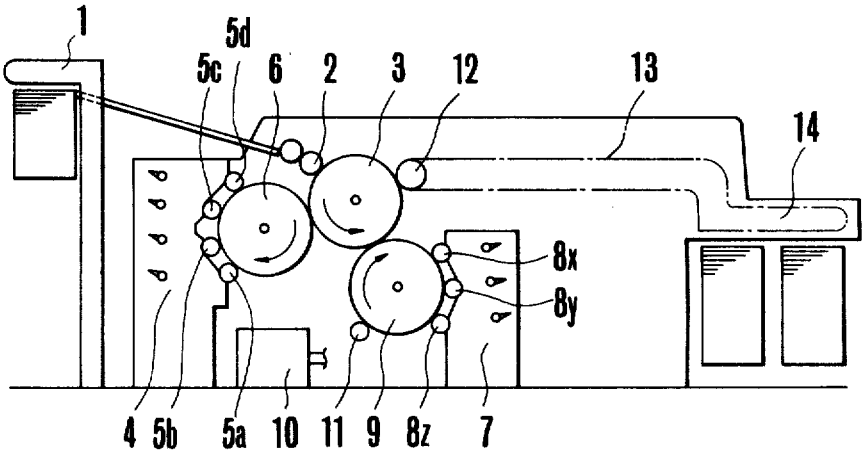
FIG.1 PRIOR ART
FIG. 1 is a diagrammatic representation of a multicolor dry offset intaglio rotary press incorporated with one embodiment of the apparatus for controlling the timing of throwing on and off a printing cylinder embodying the invention.

In the multicolor dry offset intaglio rotary press shown in FIG. 1, a sheet of paper supplied to a register station by a paper feeder 1 is transferred to an impression cylinder 3 in the form of a 4 times roller through transfer cylinders 2. Inks of various colors supplied from dry inkers 4 to dry plate cylinder 5*a*, 5*b*, 5*c* and 5*d* are transferred to the surface of the blanket cylinder 6 comprising a 4 times rollers. Inks supplied to intaglio cylinders 8*x*, 8*y* and 8*z* from an intaglio inker 7 are transferred to the surface of an intaglio plate cylinder 9 in the form of a 4 times roller. The rotary press is driven by an electric motor 10 and surplus ink deposited on the intaglio plate cylinder 9 is wiped off by a wiping roller 11.

A sheet of paper wrapped about the impression cylinder 3 is pressed against the rotating blanket cylinder 6 to undergo an offset printing and is also contacted against the intaglio plate cylinder 9 to undergo an intaglio printing. The paper printed with the both types of printing is transferred to an endless chain 13 by a delivery cylinder 12. The paper on the chain 13 is gripped by grippers of the chain to be conveyed to a delivery station 14 where the printed papers are delivered to a predetermined pile. Since mutually interlocked impression cylinder 3, the blanket cylinder 6 and the intaglio cylinder 9 are the 4 times rollers, 4 sheets of papers are printed when respective cylinders make one revolution.

Figure 2:
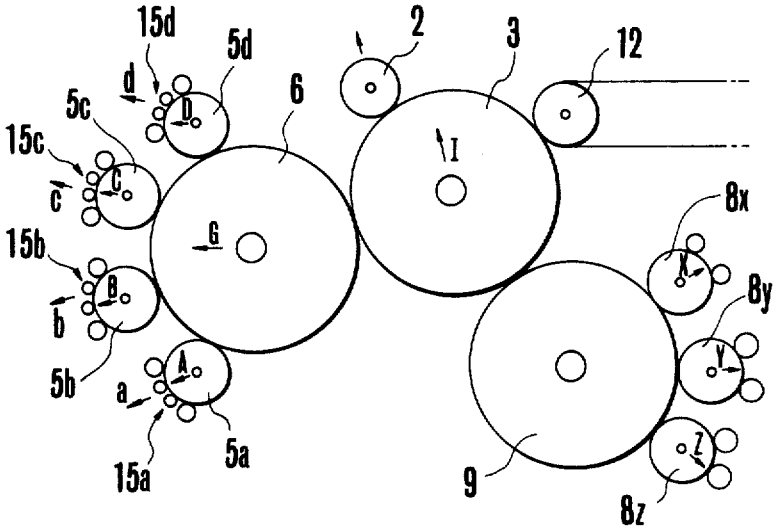
FIG. 2 is a side view for explaining a manner of throwing on and off the printing cylinder.

FIG. 2 shows a manner of throwing on or off cylinders, inking rollers and other rollers in which 15*a*, 15*b*, 15*c* and 15*d* show inking rollers for supplying inks of various colors to dry plate cylinders 5*a*, 5*b*, 5*c* and 5*d* respectively. The blanket cylinder 6 is moved relatively to the impression cylinder 3 in the direction of an arrow G, whereas and the impression cylinder 3 are moved relatively the intaglio plate cylinder 9 in the direction of an arrow I. The dry plate cylinders 5*a*, 5*b*, 5*c* and 5*d* are moved relatively to the blanket cylinder 9 in the directions of arrows A, B, C and D respectively, while the inking rollers 15*a*, 15*b*, 15*c* and 15*d* are moved relatively to the dry plate cylinders 5a, 5b, 5c and 5d in the directions of arrows a, b, c and d respectively. The intaglio inking cylinders 8x, 8y and 8z are moved relatively to the intaglio plate cylinder 9 in the directions of arrows X, Y and Z respectively. To throw on the cylinders 3, 6 and 9 they are moved in the opposite directions. The cylinders are thrown on in the directions of G→C→A→D, a, c→B→d→d→I. Description regarding directions X, Y and Z is omitted. On the other hand the cylinders are thrown off in the order of a→A, b→B, c→C, d→D→G→I.

The apparatus for controlling the timings of throwing on and off the cylinders will now be described.

In FIG. 3 showing a timing pulse generator, the impression cylinder 3, that is a 4 times roller is driven by a shaft 20 on which are mounted a first circular disc 22 having a detector 21 in the form of a radially extending projection and a circular disc 24 axially spaced from the disc 22 and having a plurality of angularly spaced detectors or radial projections, 23G, 23C, 23A, 23Dac, 23B, 23d, 23b and 23I, for example made of permanent magnet or the like. On the outside of the rotating path of the detector 21 is disposed 4 detection switches in the form of proximity switches 25a, 25b, 25c and 25d at a spacing of 90° and respectively supported by a rotating disc 26 rotatably mounted on the drive shaft 20 through supporting arms 27a, 27b, 27c and 27d. In the same manner, on the outside of the rotating path of the detectors 23G through 23I are disposed 4 detection switches, for example lead relays or magnetic sensors in the form of proximity switches 28a, 28b, 28c and 28d spaced 90° from each other and mounted on the rotary disc 26 respectively through supporting arms 29a, 29b, 29c and 29d, the proximity switches 28a through 28d being spaced from respective proximity switches 25a through 25d by a predetermined angle.

Teeth 26a are formed on the periphery of the rotary disc 26 to mesh with a gear 31 driven by a servomotor 30. As shown in FIG. 4, the driving shaft 20 is journalled by a bearing 32 and only one set of the proximity switch and the supporting arm is shown in FIG. 4. The reason why four proximity switches 25a to 25d and 28a to 28d are provided lies in that the driving shaft 20 is a 4 times drum shaft, meaning that ¼ revolution of the driving shaft 20 corresponds to one revolution of the printing rotation. As a consequence, where a detector is mounted on a n times roller shaft it is necessary to provide n proximity switches.

When the driving shaft 20 rotates in the clockwise direction as viewed in FIG. 3 the proximity switches 25a through 25d produce pulses each time the projections 21 pass by. In the same manner, proximity switches 28a through 28d sequentially produce timing signals when the projections 23G through 23I pass by. Assume now that an instruction signal that throws on the cylinders is generated in a state shown in FIG. 4, the proximity switch 25a produces a selection signal when the projection 21 passes by. In response to this selection signal, a selection circuit to be described later selects the proximity switch 28a whereby the proximity switch 28a sequentially outputs timing signals that throw on the cylinders, etc. as the projections 23G through 23I pass by the switch 28a. These timing signals are outputted at correct timings according to the angular positions of the projections 23G through 23I. It is advantageous to support the projections 23G through 23I so that they are adjustable in the peripheral direction of the disc 24 so as to finely adjust the timings of rendering operative the cylinders and the rollers.

In an ordinary printing press it is necessary to adjust the timing of throwing on or off the cylinders and the rollers to cope with a delay in a pressurized oil system which occures when the rotating speed of the printing press varies. Where the control system is constructed such that a servomotor 30 is rotated in a predetermined direction by a predetermined angle in accordance with the rotational speed it is possible to adjust the relative angular position of the proximity switch relative to the projection by the rotation of the rotary disc 26 caused by the servomotor 30, thus correcting the variation in the timings caused by a variation in the rotational speed of the printing press.

With reference to FIGS. 3 and 4, only a timing signal generator for throwing on the cylinders and the rollers has been described, but a timing signal generator for throwing off the cylinders and the rollers can be constructed similarly except that the order and angular positions of the projections 23G through 23I are different.

Figure 5:
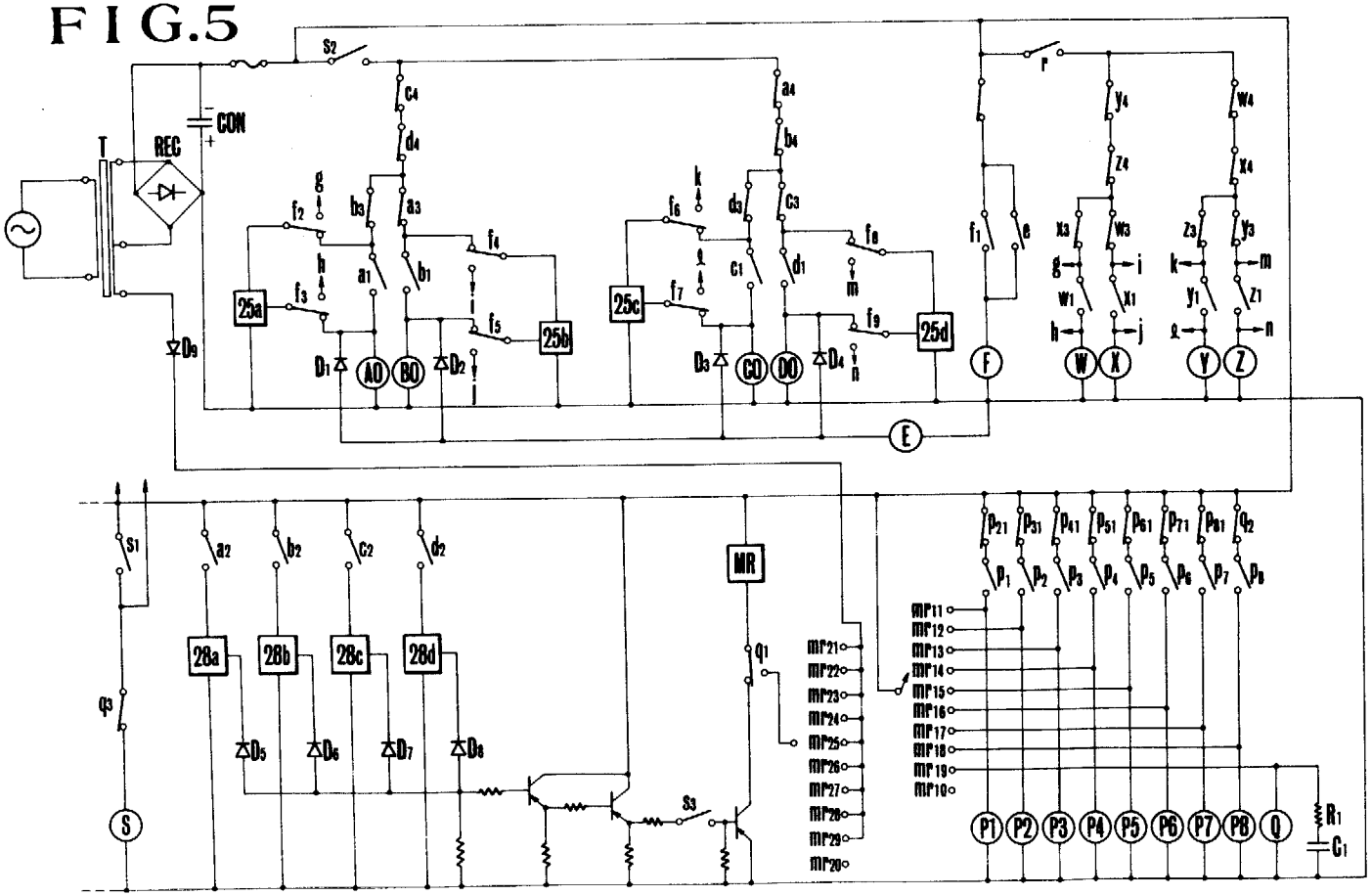
FIG. 5 is a connection diagram showing a selection driving circuit.

FIG. 5 shows the construction of the selection driving circuit. When a sheet of paper is correctly supplied to the front register station from a paper feeder an instruction signal for rendering effective the cylinders and the rollers is outputted and the instruction signal actuates a relay S to close its contacts S1, S2 and S3. Closure of the contact S, self-holds the relay S, while closure of contact S2 applies a DC voltage to a circuit including proximity switches 25a through 25d which is obtained by rectifying the secondary output of a transformer T and then smoothing the rectifier output with a capacitor CON. Closure of the relay contact S3 turns on a transistor circuit which amplifies the timing signals outputted from the proximity switches 28a through 28d. As shown in FIG. 3, when the projection 21 passes by the proximity switch 25a it produces a low level selection signal which operates a relay A0 to close its contact a1 and a2 and open its contacts a3 and a4. Closure of relay contact a1 forms a self-holding circuit of the relay A0, and closure of contact a2 selects the proximity switch 28a and applies thereto an operating voltage. Opening of the relay contact a3 deenergizes the proximity switch 25b, while opening of relay contact a4 deenergizes the proximity switches 25c and 25d. The selection signal produced by the proximity switch 25a operates a relay E to close its contact e which energizes a relay F to close its self-holding contact. For the purpose of preventing the operation of relays B0, C0 and D0 concurrently with the operation of the relays A0 and E there are provided diodes D2, D3 and D4. In the same manner, for the purpose of preventing the operation of relay A0 when another relay operates diode d1 is provided. Relay B0 has contacts b1 through b4, relay C0 has contacts C1 through C4, and relay D0 has contacts d1 through d4.

Relay contacts f2 through f9 are arranged to be transferred when the relay F operates. Stationary contacts g, h, i, j, k, l, m and n of the relay contacts f2 through f9 are respectively connected to stationary contacts g, h, i, j, k, l, m and n cooperating with the movable contacts w1, x1, y1 and z1 of the relays W, X, Y and Z. Accordingly, after the relay F has been operated, the proximity switches 25a through 25d are transferred to the circuits of the relays W, X, Y and Z which are used for rendering inoperative the cylinders and rollers to prepare for the next operation for rendering inoperative the cylinders and rollers.

Under a condition in which the operating voltage is applied to the proximity switch as the result of closure of the relay contact a3, when the projections 23G through 23I pass by the proximity switch 28*a*, low level timing signals are successively produced which turns on the transistor circuit to operate an electromagnetic rotor MR. Diodes D5 through D8 are connected to prevent mutual interaction of the outputs of the proximity switches 28*a* through 28*d*. The electromagnetic rotor MR is provided with two groups of stepping switches, the stationary contacts mr10 through mr19, and mr20 through mr29 being sequentially closed each time a timing signal is applied to the electromagnetic rotor MR. When the electromagnetic roller MR operates in response to a timing signal produced by a projection to close its stationary contact mr11, current flows through a relay P1 to close its contact P1 which establishes the self-holding circuit for the relay P1. Operation of the relay P1 energizes an output circuit, not shown, to operate a piston-cylinder assembly, to move the rubber roller 6 in a direction opposite to arrow G1 FIG. 2, to render operative the blanket cylinder. Then a timing signal generated by the projection 23*c* closes the stationary contact mr12 to operate a relay P2 thus closing its contact p2 and opening its contact p21. Closure of the relay contact p2 establishes the self-holding circuit for the relay p2, while opening of the relay contact p21 deenergizes the relay P1. Operation of the relay P2 renders operative the cylinder 5C. In response to succeeding timing signals, relays P3 through P8 operate successively, whereby cylinders and rollers are brought into engagement positions (A→D, a, C→B→d→b→I) according to predetermined timings. A relay Q is operated by a signal firstly produced by the next rotation of a projection 21 to transfer its contact q1. Then a pulse current rectified by a diode DG flows through the electromagnetic rotor MR so that the stepping switches step and stop when their stationary contacts mr10 and mr20 are closed to be reset to their original states. When the relay Q operates its contacts q2 and q3 are opened. Opening of the contact q2, resets the relay S. Then the contact s2 of the relay S is opened, the voltage is removed from the circuit of the proximity switches 25*a* through 25*d* so that the first operation which renders operative the cylinders and rollers are completed and the relay A0 is reset. However, when an instruction signal for throwing on the cylinders and the rollers is continuously outputted, the relay Q operates for only a short time determined by the time constant established by resistor R1 and capacitor C1, so that the relay contact q3 prepare for the next operation for rendering inoperative the cylinders and rollers.

At the time of throwing off the cylinders and the rollers, as a relay, not shown is operated to close its contact r, voltage is impressed upon the circuit of the relays W, X, Y and Z. Consequently relays W to Z are operated by the selection signals generated by the proximity switches 25*a* 25*d* to operate their contacts w3, w4, x3, x4, y3, y4, z3 and z4 respectively. The operation of the circuit is similar to that for throwing off the cylinders and the rollers.

According to the embodiment described above, since it is possible to adjust the relative angular position of a proximity switch relative to a projection according to the printing speed, it is possible to always produce correct timing signals. Moreover, as a proximity switch is used there is no fear of imperfect contact and can operate stably over a long time. Further, as the stepping operation is made with an electromagnetic rotor, there is no misoperation caused by noise as in the prior art preset counter.

Although in the foregoing embodiment, the invention was applied to a dry offset intaglio printing press, it will be clear that the invention is also applicable to a multicolor sheet printing press.

As above described, with the apparatus for controlling timings of throwing on and off cylinders and rollers according to this invention, it is possible to simplify the construction of the control apparatus so that it can reduce faults and misoperations thus making correct and stable the timings of throwing on and off the cylinders and the rollers.

What is claimed is:

1. Apparatus for controlling timings of throwing on and off cylinders of a printing press comprising:

a first detection member mounted on a driving shaft of a n times cylinder, where n is an integer larger than 2;

n first detection means for producing selection signals when said first detection member passes by, said first detection means being spaced circumferentially by an equal angle;

a plurality of second detection members mounted on said driving shaft at predetermined angular positions;

n second detection means for producing timing signals when said second detection members pass by, said second detection means being spaced circumferentially by an equal angle;

means for selecting either one of said second detection means according to said selection signal; and means responsive to a timing signal produced by said selected second detection means for throwing on or off cylinders of said printing press.

2. The apparatus according to claim 1 wherein said second detecting members include a plurality of radially extending salient members, and wherein said second detection members include a plurality of proximity switches disposed on a circle encircling tips of said salient member so as to produce said selection signal and said timing signal, respectively when the tips of said salient members pass by said proximity switches.

3. The apparatus according to claim 2 which further comprises means for adjusting relative angular positions of said proximity switches and said radially extending salient members.

* * * * *